US008113443B2

(12) United States Patent
Zur

(10) Patent No.: US 8,113,443 B2
(45) Date of Patent: Feb. 14, 2012

(54) ROTARY SPRINKLER

(75) Inventor: Yoel Zur, Korazim (IL)

(73) Assignee: Clever Water Sprinkler Technologies Ltd., Tzoran (IL)

( * ) Notice: Subject to any disclaimer, the term of this patent is extended or adjusted under 35 U.S.C. 154(b) by 385 days.

(21) Appl. No.: 12/514,469

(22) PCT Filed: Oct. 31, 2007

(86) PCT No.: PCT/IL2007/001328

§ 371 (c)(1),
(2), (4) Date: May 12, 2009

(87) PCT Pub. No.: WO2008/062398

PCT Pub. Date: May 29, 2008

(65) Prior Publication Data

US 2010/0012746 A1 Jan. 21, 2010

Related U.S. Application Data

(60) Provisional application No. 60/866,625, filed on Nov. 21, 2006.

(51) Int. Cl.
*B05B 3/04* (2006.01)

(52) U.S. Cl. ..... 239/240; 239/225.1; 239/231

(58) Field of Classification Search ..... 239/240, 239/225.1, 227, 230, 231, 237, 242, 206
See application file for complete search history.

(56) References Cited

U.S. PATENT DOCUMENTS

| | | | | |
|---|---|---|---|---|
| 3,452,930 | A | | 7/1969 | Karbo |
| 3,830,434 | A | | 8/1974 | Green et al. |
| 3,952,954 | A | | 4/1976 | Taylor |
| 4,119,275 | A | | 10/1978 | Hunter |
| 4,501,391 | A | * | 2/1985 | Hunter ..... 239/97 |
| 4,534,510 | A | | 8/1985 | Rinkewich |
| 4,540,125 | A | | 9/1985 | Gorney et al. |
| 4,819,875 | A | | 4/1989 | Beal |
| 5,098,021 | A | | 3/1992 | Kah, Jr. |
| 5,199,646 | A | * | 4/1993 | Kah, Jr. ..... 239/240 |
| 5,248,093 | A | | 9/1993 | Pleasants |
| 5,366,157 | A | | 11/1994 | Pleasants |
| 5,704,549 | A | | 1/1998 | Kephart et al. |
| 6,464,151 | B1 | | 10/2002 | Cordua |
| 6,637,672 | B2 | | 10/2003 | Cordua |

FOREIGN PATENT DOCUMENTS

| | | |
|---|---|---|
| FR | 2 555 914 A1 | 6/1985 |
| GB | 2 150 862 A | 7/1985 |
| WO | WO 97/02897 A1 | 1/1997 |

* cited by examiner

*Primary Examiner* — Davis Hwu

(74) *Attorney, Agent, or Firm* — Oliff & Berridge, PLC

(57) ABSTRACT

A sprinkler for discharging liquid onto an area with a predetermined geometrically shaped perimeter while maintaining a substantially constant liquids precipitation over said area. The sprinkler comprises a housing fitted with a flow chamber accommodating a motor for rotating a sprinkler head mounted on the housing, the housing comprising a first nozzle and a second nozzle, in flow communication with the outlet end of the flow chamber. The first nozzle fitted for discharging liquid at a substantially short range. The sprinkler further comprises a dynamic liquid deflector associated with the second nozzle, and biased by an array of biasing elements, each adapted to dynamically bias the liquid deflector to a predetermined angle, thereby determine a deflection angle thereof.

24 Claims, 9 Drawing Sheets

ROTARY SPRINKLER

FIELD OF THE INVENTION

The present invention is generally in the field of irrigation sprinklers, and more particularly it is concerned with rotary sprinklers adapted for irrigation of areas of various patterns.

BACKGROUND OF THE INVENTION

The use of sprinklers in order to provide irrigation to a desired area such as a field, a lawn etc. is well known in the art. However, there is often a need to irrigate areas having an irregular pattern. One solution could be providing an array of sprinklers to adequately cover such an area, in an overlapping manner. This however, may cause a problem resulting from excessive watering of certain areas owing to overlapping zones between sprinklers, or to other zones having poor irrigation. This solution is also significantly costly.

Another solution is the provision of sprinklers design to emit water at a predetermined shape. An example of such sprinklers is the so-called 'strip irrigators' is adapted for emitting water over a narrow strip of land.

Several solutions for irrigation of an area having a shape of an amorphic perimeter have been disclosed as well.

For example, GB2150862 to Schwartzman discloses a water distributing device comprises a nozzle; means to deliver water to the nozzle; a camming surface concentrically disposed about the axis of rotation of said nozzle; a cam setting means to vary the height of said camming surface; and a cam follower contacting at one end said cam surface and at the other end said spray nozzle to vary the spray pattern emitting from the nozzle in accordance with the relative height set of the camming surface. Valve means responsive to said cam setting vary the quantity of water dispersed in relation to the pattern set by the camming surface. When applied to an oscillating type water-sprinkler, the cam follower means is disposed on the splash plate and rotates around the camming surface. Means are provided to specifically mount the base of the water distributing device attitude in a fixed attitude so that it can be removed and replaced and still maintain the same exact location so that the previously set camming determined spray pattern will still be applicable to the repositioned or to the remounted sprinkler or water distributing apparatus.

Hereinafter in the specification and claims, the term sprinkler is used in its broad sense and is used to denote a sprinkler for emitting any liquid, not only for irrigation purposes but also, for example, for frost protecting of crops by mist precipitation, wetting/humidifying areas and materials, etc.

SUMMARY OF THE INVENTION

It is an object of the present invention to provide a sprinkler for programmable and controlled discharge of liquid onto areas having a different geometrically shaped perimeter, whilst maintaining a substantially constant liquid precipitation over said area.

This is obtained by providing a sprinkler wherein liquid precipitation is dominated by variable liquid flow rate emitted through the sprinkler, variable liquid emitting distance (measured from the sprinkler—i.e. irrigation radii) and optionally, controllable speed of the sprinkler.

According to the invention there is provided a sprinkler for discharging liquid onto an area with a predetermined geometrically shaped perimeter, said sprinkler comprising a housing fitted with a flow chamber accommodating a hydraulic motor for rotating a sprinkler head mounted on said housing, the housing comprising a first nozzle and a second nozzle being in flow communication with the outlet end of the flow chamber, said first nozzle fitted for discharging liquid at a constant flow rate; said sprinkler further comprising a dynamic liquid deflector associated with the second nozzle, and biased by an array of biasing elements, each adapted to dynamically bias said liquid deflector to a predetermined angle, thereby determine a deflection angle thereof.

According to an embodiment of the invention the hydraulic motor is dynamic and has a speed regulator for governing rotary speed of the sprinkler head depending on the flow rate emitted through the second nozzle. According to this embodiment the dynamic hydraulic motor is linked to the dynamic liquid deflector whereby deflection of the liquid deflector results in change of rotary speed of the dynamic hydraulic motor.

Variable speed of the dynamic hydraulic motor may be obtained, for example, by a coupler associated at one end with the liquid deflector and at an opposite end thereof with an axially displaceable turbine of the dynamic hydraulic motor, said turbine being mounted within a chamber formed with one or more tangentially extending liquid jet apertures, whereby axial displacement of the turbine results in its axial displacement with respect to said one or more apertures, which in turn entails reducing/increasing of the rotation of said turbine and the associated housing.

According to another embodiment of the invention the housing is fitted with a first feed line and a second feed line, both extending from the flow chamber and each having an outlet end; said first feed line extending through the hydraulic motor to thereby rotate the sprinkler head at a substantially constant speed, said first feed line fitted at an outlet end thereof with the first nozzle fitted for discharging a liquid at a substantially constant flow rate; said second feed line being fitted at an outlet end thereof with the second nozzle.

According to a particular design of the invention the second nozzle is fitted with a flow regulator for regulating liquid flow discharged through the second nozzle, where deflection of the dynamic liquid deflector entails simultaneous governing of the flow regulator, to thereby emit liquid through the second nozzle at a flow rate corresponding with the range (irrigation radius) set by a respective biasing element.

According to embodiments of the present invention the first nozzle is adapted for discharging a constant amount of liquid at substantially short/near range. By a particular design, the first nozzle is fitted for discharging a liquid at a substantially constant flow rate and a fixed range to emit liquid over a circular pattern or a sectorial pattern.

Furthermore, the second nozzle is fitted for discharging a variable liquid flow rate at longer and variable ranges.

A wide variety of hydraulic motors may be used in conjunction with the sprinkler of the present invention for rotating the sprinkler head. According to one embodiment of the invention the hydraulic motor is of the type comprising a distribution member rotatable with respect to the housing, the inlet chamber being in flow communication with an inlet port of the housing and with the sprinkler head, and an impeller mechanism articulated with the second nozzle.

According to a particular embodiment, the impeller mechanism is ball-driven wherein said inlet chamber is formed with tangentially directed water inlet apertures for imparting to the ball a rotational motion, whereby impact of the ball and the impeller mechanism results in the transfer to the impeller mechanism of the ball's momentum, causing rotational displacement of the impeller element and its associated second, long-range nozzle. However, according to another embodiment, the motor is an electric motor. Still further, the motor is fitted with a gear mechanism to provide a speed-power conversion from a higher speed to a slower but more forceful output.

According to an embodiment of the invention, the housing is formed as an essentially cylindrical tube having a static base member and a rotatable distribution member articulated thereto, said base member comprising the inlet chamber wherefrom said first and said second feed line extend, and adapted to be connected to a liquid supply line. The discharge end accommodating the first nozzle and the second nozzle; the rotatable distribution member is fitted with the dynamic liquid deflector and a sprinkler top comprising the radial biasing elements.

The sprinkler top is spaced from the static base member and is fitted with a plurality of radially directed biasing elements, said biasing elements being independently radially displaceable so as to form an imaginary path extending between said plurality of biasing elements, whereby a cam/roller follower associated with the dynamic liquid deflector travels over said biasing elements to thereby angularly disposition the dynamic liquid deflector.

The biasing elements are radially directed towards a longitudinal (vertical) axis of the sprinkler, each biasing element being radially displaced within the sprinkler top so as to adjust the distance of a proximal (inner-most) end of each biasing member from said longitudinal axis. Adjusting the radial distance of the biasing members may be by screwing along a helical path, pressure fit, etc.

The arrangement is such that the imaginary path extending between said plurality of biasing elements corresponds at an inverted fashion with the perimeter of the irrigated area, i.e. biasing elements associated with outermost locations of the area are radially most radially retracted (radially inwardly), and vise versa.

Angular disposition of the dynamic liquid deflector is a pivotal motion with respect to a longitudinal axis of the sprinkler.

The sprinkler top is spaced from the static base member by one or more support studs having a hydro-dynamic cross-section so as to cause minimal interference with liquid jets emitted from the first and second outlet nozzles.

The sprinkler top is fixedly spaced from the static base member though it may be rotatably displaced thereabout between a plurality of discrete positions.

The flow regulator fitted at the second outlet nozzle is fitted for partially obstruct the second feed line, thereby regulating the amount of liquid discharged threw the second nozzle. According to a design of the invention, the flow regulator is in the form of a plunger at least partially impinging with the second feed line, thereby restricting the cross-section of said second feed line and obstructing fluid flow. Furthermore, the plunger's end may be configured in a variety of cross-sectional forms, thus allowing more intricate regulation of the discharged liquid.

According to embodiments of the invention the plunger of the flow regulator may be interchangeable. Furthermore, the flow regulator may be fitted with a biasing spring biasing it to minimal its interference within the second feed line.

According to a particular design, the dynamic liquid deflector is in the form of an arm pivotally articulated to the rotatable sprinkler head such that a deflecting end thereof extends in front of the second outlet nozzle for selectively deflecting liquid emitted therefrom. A cam follower member is fitted on said dynamic liquid deflector for engagement with the array of radial biasing elements.

The deflecting arm may be hinged to the rotatable sprinkler head such that pivotal displacement of the arm under biasing effect of the biasing elements, in a substantially radial direction, entails corresponding pivotal displacement of the deflecting end about an arced path opposite said second outlet nozzle, thereby altering the angle of discharge of the liquid jet. The deflecting end may be formed with an essentially flat deflecting portion, or it may be formed in different shapes, e.g. concave, with radial grooves, etc. for imparting the emitted liquid jet different desired patterns, such as splitting or converging the jet, to thereby obtain better coverage of the concerned area. According to an embodiment of the invention, the deflecting portion may be interchangeable.

According to a specific design of the invention, a middle portion of the deflecting arm bears over a distal end of said flow regulator plunger projecting from the sprinkler head, whereby deflection of the dynamic fluid deflector governs the amount to which the plunger of the flow regulator impinges with the second feed line, to thereby regulate the amount of liquid emitted from the second nozzle in correlation with the desired angle of discharge, i.e. with the distance of the emitted jet, thereby confirming constant precipitation.

According to a specific embodiment the plunger of the flow regulator is formed at its distal end with a concave surface corresponding with a bottom surface of the flow deflecting arm such that pivotal displacement of the arm entails substantially pure rolling motion over said plunger. However, according to other embodiments, the distal end of the plunger and the bottom surface of the flow deflecting arm are so designed as to impart the plunger axial displacement at non-linear ratio responsive to pivoting of the deflecting arm. For example, at the low elevations of the of the deflecting arm (i.e. where the deflecting tip nears to the second outlet nozzle) the axial displacement of the plunger is non linear and will be significantly more then at high elevations of the of the deflecting arm (i.e. where the deflecting tip departs from the second outlet nozzle), thereby obtaining varying interference with liquid flow towards the second nozzle.

Accordingly, when the angle of deflection is greater (i.e. the deflecting arm is pivoted and interferes more with the second nozzle), the flow regulator is further depressed into the second feed line, thus blocking a larger portion of the outlet of said second feed line. This results in a lesser amount of liquid being discharged from the second, long-range nozzle. However, the opposite occurs when the deflecting arm is less pivoted, i.e. the plunger less interferes with the second feed line and a greater flow is admitted through the second nozzle, corresponding with the long range, thereby allowing more uniform precipitation of said area.

In operation, as will be discussed in detail later, each biasing element is adapted to determine the amount to which the biased end of said dynamic liquid deflector is pivoted. This in turn determines to which extent the deflecting end thereof obstructs the second, long-range nozzle, and consequently the angle of liquid discharge, and also the extent to which the flow regulator interferes the second feed line, and consequentially with the liquid flow rate through the second nozzle.

In operation, liquid from the inlet chamber flows into the inlet end of said first and said second feed lines. The liquid running through said first feed line passes through the hydraulic motor, thereby operating it at constant rotary motion of the discharge port of the sprinkler (also with respect to a given liquid pressure supply). When exiting the hydraulic motor, the water reaches the outlet port and the first, short-range nozzle and provides a constant liquid flow rate at a constant angle to the area to be irrigated.

Liquid flowing through the second feed line directly reaches the second, long-range nozzle, where it may be obstructed by the deflecting end of the dynamic liquid deflector. During rotation of the second nozzle, the biased end of the dynamic liquid deflector alternately comes in contact with a different biasing element, whereby the extent of obstruction of the flow through the second feed line towards the second nozzle, varies in accordance with the radial projection of each biasing element and simultaneously the distal end of the flow regulator is biased downwards at a corresponding extent consequently deflecting liquid emitted from the second nozzle.

Thus, in each direction the nozzles of said first and said second feed lines are directed, the angle of discharge may be different allowing coverage of virtually any geometric planar shape of an irrigated area. Furthermore, the constant amount of water being discharged from the first, short-range nozzle of said first feed line, and the regulated amount of liquid discharged from said second, long-range nozzle allows uniform precipitation of the liquid across all the irrigated area. More particularly, the first feed line and the second feed line are independent. Therefore a change in the amount of discharged water from the second feed line does not affect the discharge from the second feed line, facilitating uniform irrigation throughout the entire area.

Lowering the deflecting angle of liquid distributed throughout the second nozzle may result in reducing the rotational speed of the distribution head and thus speed increase is required so as to maintain a substantially constant rotational speed of the distribution head.

According to still an embodiment of the present invention, the sprinkler is fitted with a flow regulator to generate a substantially constant liquid flow rate directed to both the first and second nozzles.

BRIEF DESCRIPTION OF THE DRAWINGS

In order to understand the invention and to see how it may be carried out in practice, some embodiments will now be described, by way of non-limiting examples only, with reference to the accompanying drawings, in which.

DETAILED DESCRIPTION OF EMBODIMENTS

Figure 1A:
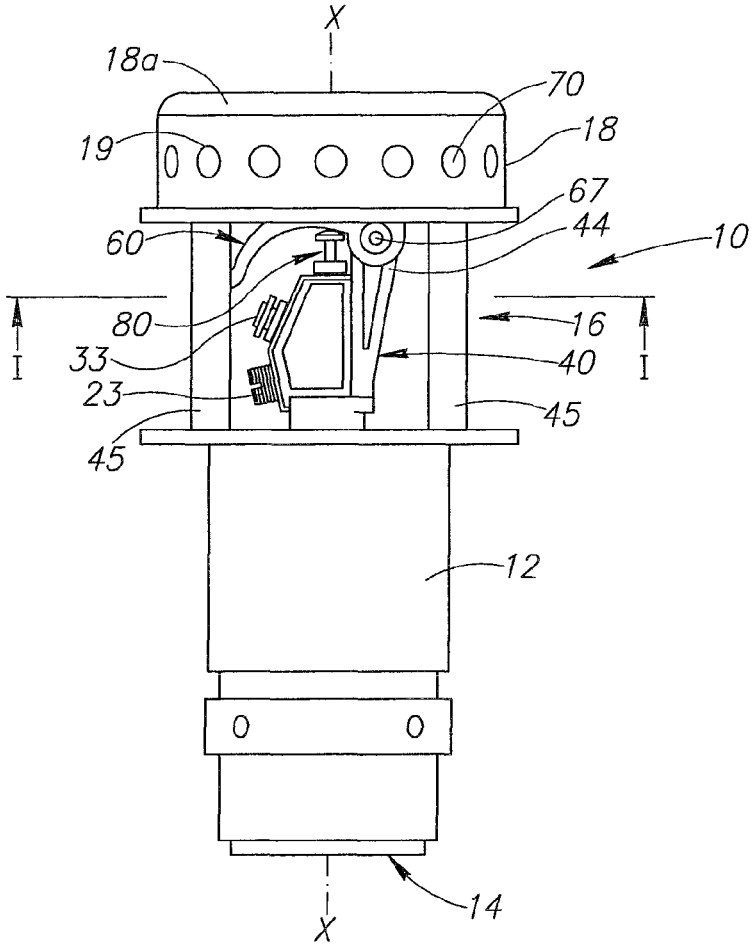
FIG. 1A is a schematic side view of the sprinkler according to the present invention.

Referring to FIG. 1A there is provided a sprinkler generally designated 10 having an essentially cylindrical body 12 having a longitudinal axis X-X with a static base member 14 fitted for coupling to a liquid supply line (not shown), and a rotatable sprinkler head (distribution member) 16 serving as a discharge end. The sprinkler 10 is adapted to be attached to a feed port (not shown) located in or in the vicinity of an area to be irrigated such that an irrigation liquid, e.g. water may be introduced through the static base member 14 and be discharged through the rotatable distribution member 16, as will be described hereinafter.

Figure 2:
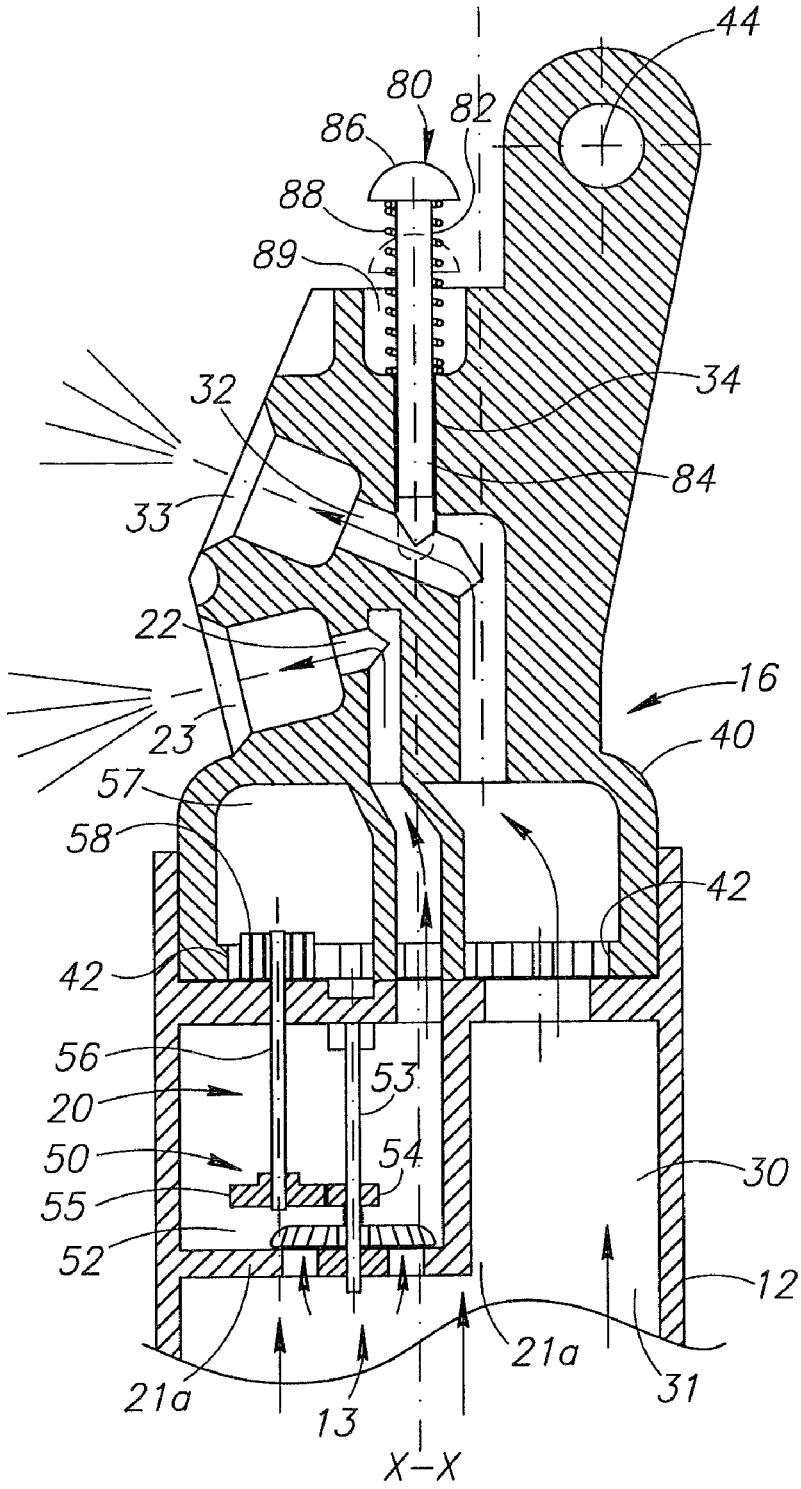
FIG. 2 is a longitudinally sectioned view of a top portion of the sprinkler of FIG. 1A, with a deflecting mechanism removed.

Turning to FIG. 2 the sprinkler 10 is formed with a flow chamber 13 being in flow communication with the liquid supply line (not shown) and splitting into a first feed line generally designated 20 and a second feed line 30. The first feed line 20 has a first inlet in the form of inlet ports 21*a*, and being in flow communication with the flow chamber 13, and an outlet 22 located at the rotatable distribution member 16 of the sprinkler, terminating at a first outlet nozzle 23.

The second feed line 30 has an inlet 31 located at the flow chamber 13, and an outlet 32 located at the rotatable distribution member 16 of the sprinkler 10 terminating at a second nozzle 33. The first nozzle 23 of the first feed line 20 is a substantially short-range discharge nozzle, and the second nozzle 33 of the second feed line 30 is a longer range discharge nozzle. Between the inlet ports 21*a* and the outlet 22, the first feed line 20 extends through a hydraulic motor assembly generally designated 50. The second feed line 30 on the other hand passes directly through the body 12 of the sprinkler 10 without passing through the motor assembly 50.

The rotatable distribution member 16 of the sprinkler 10 is formed with a coupling portion 40 rotatably and sealingly coupled at a top end of the sprinkler body 12. The motor assembly 50 comprises a turbine wheel 52 extending opposite the inlet ports 21*a* and mounted on a first axle 53, a coaxial pinion gear 54 engaged with a gear 55 mounted on a second, parallel axle 56. Fitted within a top chamber 57 and coaxially mounted on the second axle 56 there is a rotary gear 58 which is engaged for rotation with an internal gear 42 formed at a bottom of the coupling portion 40. The gear train serves a speed reducing mechanism.

Liquid entering through the inlet ports 21*a* strike against the turbine wheel 52 causing it to rotate and resulting in revolving of the coaxial pinion gear 54 which in turns entails rotary motion of the gear 55 and the associated gear 58, resulting in imparting rotary motion to the sprinkler head 16.

However, it should be noted that various impeller mechanisms may be used, for example a ball-driven in which the inlet chamber is formed with tangentially directed water inlet apertures adapted for imparting to the ball a rotational motion. The impact of the ball and the impeller mechanism results in the transfer to the impeller mechanism of the ball's momentum, causing rotational displacement of the impeller element and its associated second, long-range nozzle 23. It should also be noted that instead of a hydraulic motor there may be used an electric motor for rotating the sprinkler head 16 with respect to the base 12.

In operation, water supplied from a liquid supply line (not shown) enters the flow chamber 13 of the static base member 14 and is then divided into two routes: one passing through the inlet a 21*a* of the first feed line 20 entering the motor 50, operating it, and exiting through the first outlet port 22 and out through the short-range nozzle 23, and the other passing through the second inlet port 31 of the second feed line 30 to be discharged through the second outlet port 32 and long-range nozzle 33.

The outlet 32 of the second feed line 30 is formed with a fork like extension 34 adapted for receiving therein a flow regulator 80, the purpose of which will be explained in detail later.

Figure 3A:
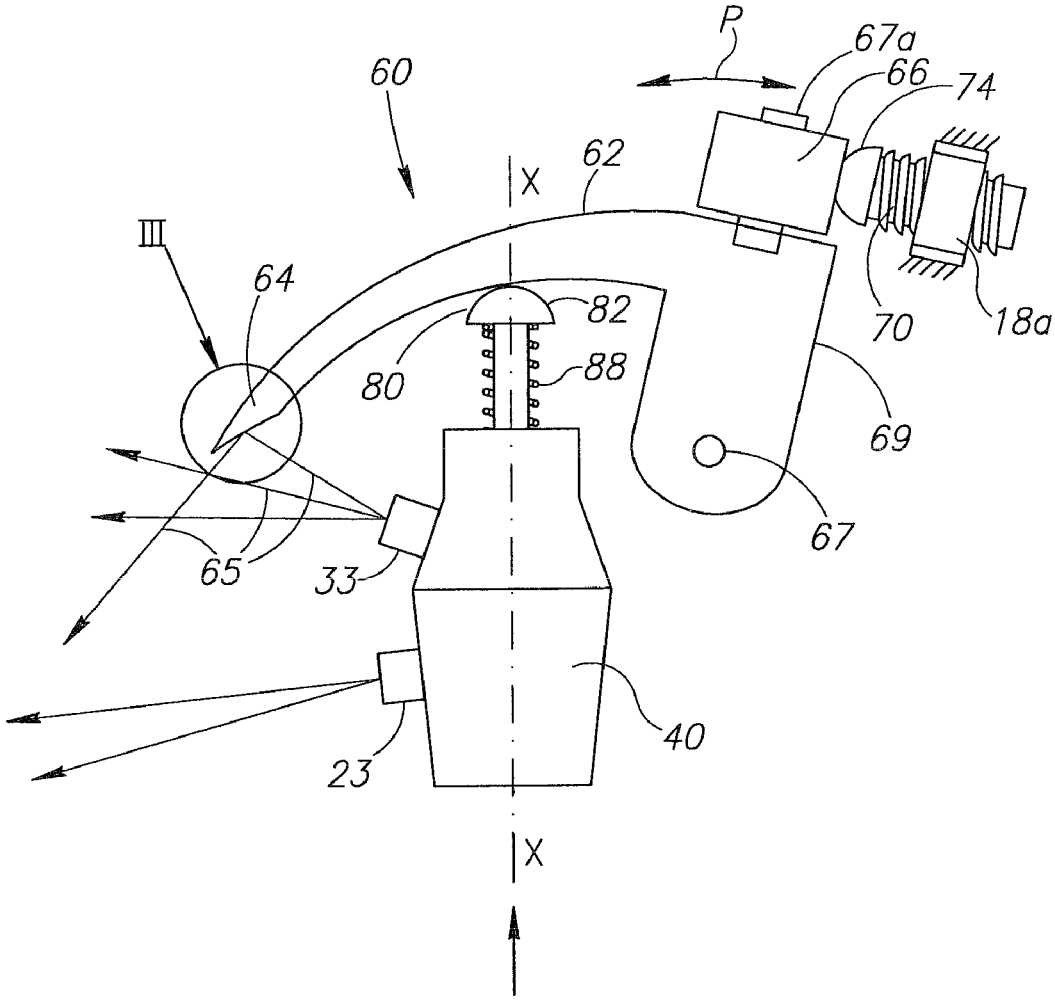
FIG. 3A illustrates the discharge end of the sprinkler along with the deflecting mechanism and a biasing element used in the regulator.
Figure 3B:
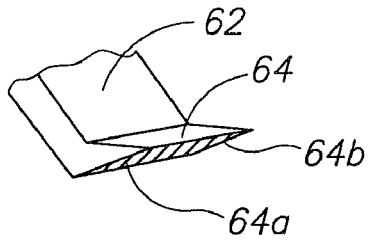
FIG. 3B is an enlargement of the deflecting portion marked III in FIG. 3.

Turning to FIGS. 3A and 3B, the dynamic liquid deflector 60 is illustrated in further details, being in the form of a deflecting arm 62 pivotally articulated through pivot 67 of extension 69 to an upward extension 44 (FIG. 2) of the to the rotatable sprinkler head (distribution member) 16. The deflecting arm 62 is formed with a deflecting portion 64 adapted to selectively come in contact with the water jet emitted from the second nozzle 33 in order to change its angle as represented by arrows 65.

The dynamic liquid deflector 60 further comprises a cam follower 66 in the form of a roller follower rotatably mounted on an axle 67*a* and adapted to come in contact with an array of radial biasing elements 70 only one of which, referred to as an 'in-duty biasing element' is shown in FIG. 3A.

The deflecting arm 62 is pivotally hinged such that displacement of the cam follower 66 of the deflecting arm 62 towards the main axis X-X entails corresponding pivotal displacement of the deflecting arm 62 in direction of arrow P in FIG. 3A. The movement of the deflecting portion 64 towards the long-range nozzle 33 thereby changing the angle of the discharged water as shown by arrows 65. As seen in FIG. 3B the deflecting portion 64 is formed with an essentially flat portion 64*a* having grooves 64*b* therein, adapted for splitting the discharged water into a number of streams for better coverage of the irrigated area. These grooves may however have deferent forms for diverting or converging a liquid jet emitted from the nozzle 33. It is however noted that the deflecting portion 64 interferes with the liquid jet emitted from the nozzle 33 only under a certain elevation (pivotal displacement).

Figure 1B:
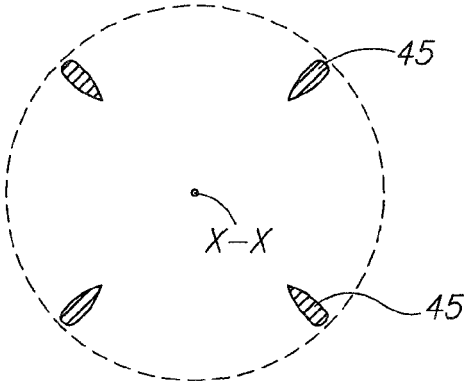
FIG. 1B is a schematic cross section along line I-I in FIG. 1A, with the irrigation head removed.
Figure 5:
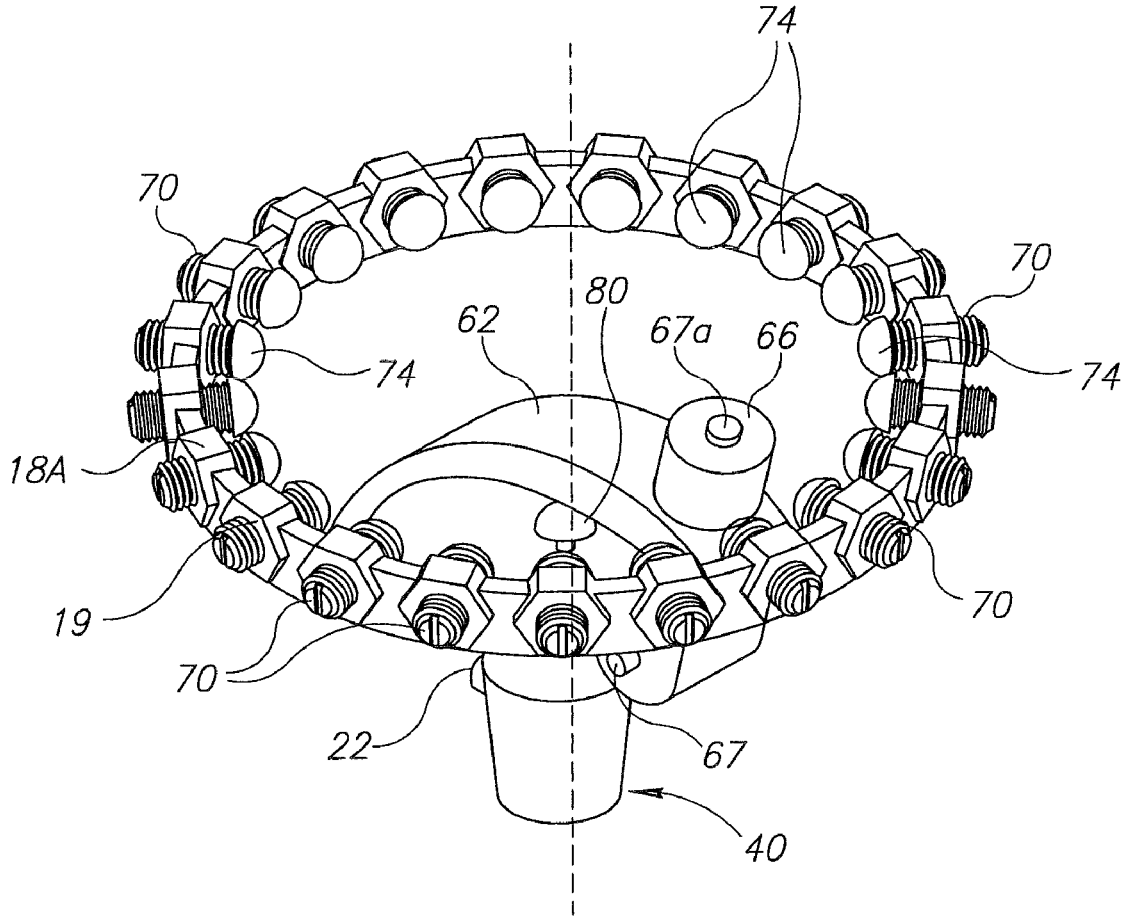
FIG. 5 is a top isometric view of the liquid deflector and the associated biasing array.

Reverting to FIG. 1 and with further reference also to FIG. 5, the sprinkler 10 has a top head 18 of an essentially circular shape having its center coinciding with the main axis X-X of the cylindrical body 12. The sprinkler top 18 is spaced from the top end of the static base member 12 by four studs 45, which as can be seen in FIG. 1B said studs 45 have a hydrodynamic cross section suited for minimal obstruction of the water jet emitted from the nozzles 23 and 33.

The sprinkler top 18 is formed on its sidewall 18*a* with a plurality of radially extending positioning holes 19 spaced around the perimeter thereof. The axis of each of those positioning holes 19 is directed at the center of the sprinkler top 18. Each of the positioning holes 19 receives a radial biasing element 70 (FIGS. 4 and 5). Each of the holes 19 and the biasing element 70 is threaded to allow axial displacement of the radial biasing elements 70 therein, in a radial direction.

Reverting to FIGS. 1 to 4 a flow regulator 80 is provided in the form of a plunger 82 received within the extension 34 of the second feed line 30 and is axially displaceable therein such that its proximal end 84 is suited for partially obstructing the flow of liquid from the second feed line 30 into the long-range nozzle outlet 32, and its distal end 86 projects from the distribution head 16. The flow regulator 80 is fitted with a biasing spring 88 positioned between the distal end 86 end a base of a receiving cavity 89 (FIG. 1)) for biasing the plunger 82 upwards. By changing the axial position of the flow regulator 80, the amount of liquid discharged through the long-range nozzle 32 may be governed. It is to be appreciated that rather then biasing spring 88 there may be other arrangements for biasing the plunger outwards from the extension 34) e.g. hydraulic arrangements.

Figure 4A:
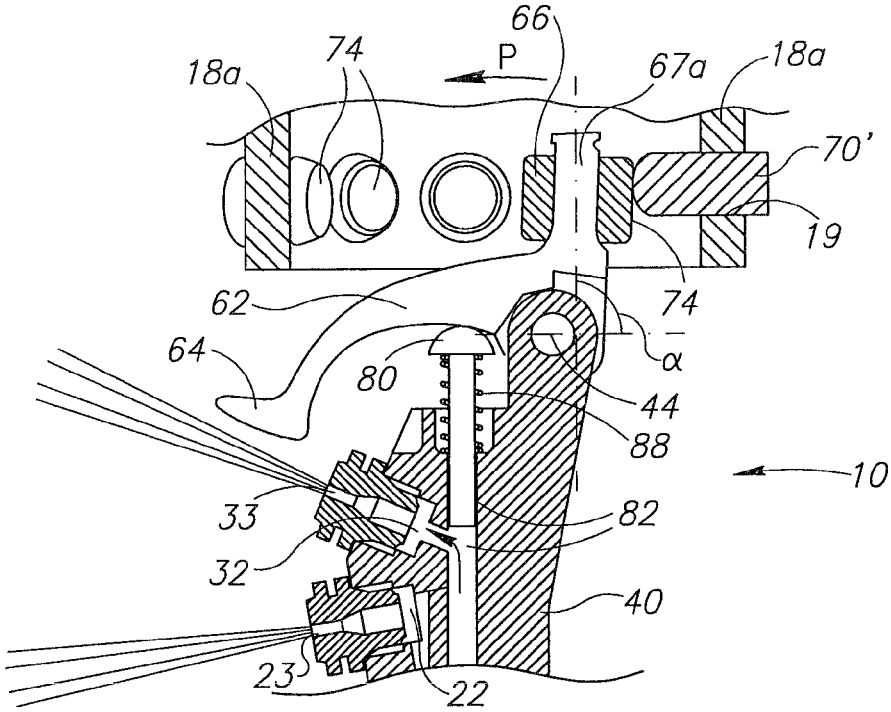
FIGS. 4A and 4B illustrate the deflecting mechanism in two respective positions.
Figure 4B:
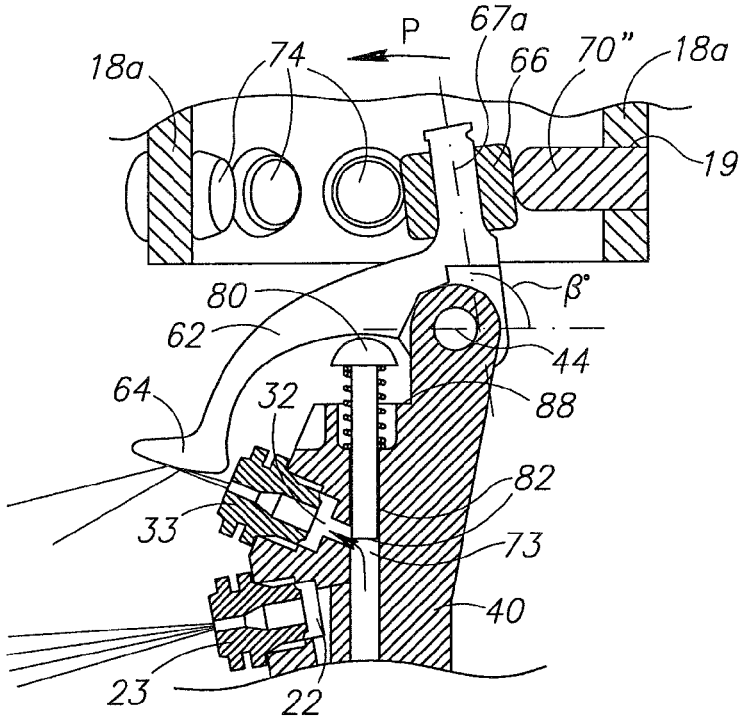

As can best be seen in FIGS. 3A, 4A and 4B the distal end 86 of the flow regulator 80 is in the form of a hemisphere being in contact with a middle portion of the deflecting arm 62 of the dynamic fluid deflector 60, whereby pivotal deflection of the arm 62 by a biasing element 70, in direction of arrow P entails depression of the plunger 82 downwards into the extension 34 further interfering with flow through the outlet 32 of the second feed line 30.

In assembly, after mounting the sprinkler 10 onto the main feed line (not shown) in order to irrigate a certain area, each of the radial biasing elements 70 is radially adjusted within the respective positioning hole 19 of the sprinkler top 18 according to the geometric shape of the perimeter of the area to be irrigated.

In operation, the liquid from the feed line enters the flow chamber 13 of the static base member 14 wherein part of the liquid enters the inlets 21*a* of the first feed line 20, and another portion of the liquid enters the inlet 31 of the second feed line 30. The liquid flowing through the first feed line 20 reaches the hydraulic motor 50, where it operates the gears as discussed hereinabove, resulting in rotation of the sprinkler head 16 with respect to the cylindrical body 12 of the sprinkler 10. When exiting the hydraulic motor 50, the liquid flowing through the first feed line 20 reaches the short-range nozzle 23 and provides a constant amount of liquid at a constant angle to the area to be irrigated.

The liquid flowing through the second feed line 30 reaches the second outlet 32 where it is first obstructed by the proximal end 84 of the flow regulator, to an extent determining the amount of water to pass towards the long-range nozzle 33, in correspondence with the extent of radial protrusion of the biasing elements 70.

After reaching the long-range nozzle, the liquid jet emitted from the outlet nozzle 33 may be obstructed by the deflecting portion 64 of the dynamic liquid deflector 60, determining the actual irrigation Range. During rotation of the sprinkler head 16, the cam follower 66 of the dynamic liquid deflector 60 alternately comes in contact with a biasing end 74 of a different biasing element 70, whereby the extent of obstruction of the second nozzle 33 varies according to the radial distance of each of the biasing end 74 from the main axis X-X of the cylindrical body 12.

The distal end of the flow regulator 80 is positioned under the deflecting arm 62 such that deflection of the deflecting portion 64 of the dynamic liquid deflector 60 entails corresponding depression of the proximal end 84 of the plunger 82 into the extension 34.

In FIG. 4A, the deflection arm 62 is shown to be only slightly biased in direction of arrow P. The in-duty biasing element 70' is partially displaced in the inward radial direction, whereby its biasing end 74 slightly biases the cam follower 66, at an angle $\alpha°$. As a result, the deflecting portion 64 of the deflecting arm 62 does not interfere with the jet emitted through the nozzle 33 so as to obtain substantially long range irrigation. Plunger 82 is depressed depending on the radial displacement of the in-duty plunger 70'. In the present example, the deflecting portion 64 of the arm 62 does not interfere with the emitted liquid jet, nor does the plunger 80 is project into the outlet 32, leaving a wide flow path and thus not interfering with the liquid flow passing towards the outlet nozzle 33, to thereby achieve a maximum range and flow rate.

Turning to FIG. 4B the deflection arm 62 is shown in a biased position. An in-duty biasing element 70" is received within the positioning hole 19 and projects to a significant extent radially inwards such that its biasing end 74 comes into contact with the cam follower 66 thereby biasing it to pivot in direction of arrow P, at an angle $\beta°$. As a result, the deflecting portion 64 of the arm 62 deflects the stream of liquid emitted from the long range nozzle 33, and the plunger 82 is depressed, leaving a narrowed flow path 73 leading to the discharge end of the long range nozzle 33, whereby the liquid flow is reduced in correspondence with deflection of the jet in a nearer range, in accordance with the irrigation pattern dictated by the extent of radial setting of the in-duty biasing element.

Thus in each direction the discharge nozzles 23 and 33 are directed, the angle of discharge and liquid flow rate are different, allowing coverage of virtually any geometric planar shape of irrigation area. Furthermore, the correspondence between the deflection extent of the liquid by the dynamic liquid deflector 60 and the obstruction of the liquid flow by the flow regulator 80 provides substantially uniform precipitation of water across all of the irrigated area. More particularly, the first feed line 20 and the second feed line 30 are independent, i.e. the amount discharged from the long-range nozzle 32 does not affect the constant amount of water discharged from the short-range nozzle 22, facilitating uniform irrigation throughout the entire area.

Figure 6:
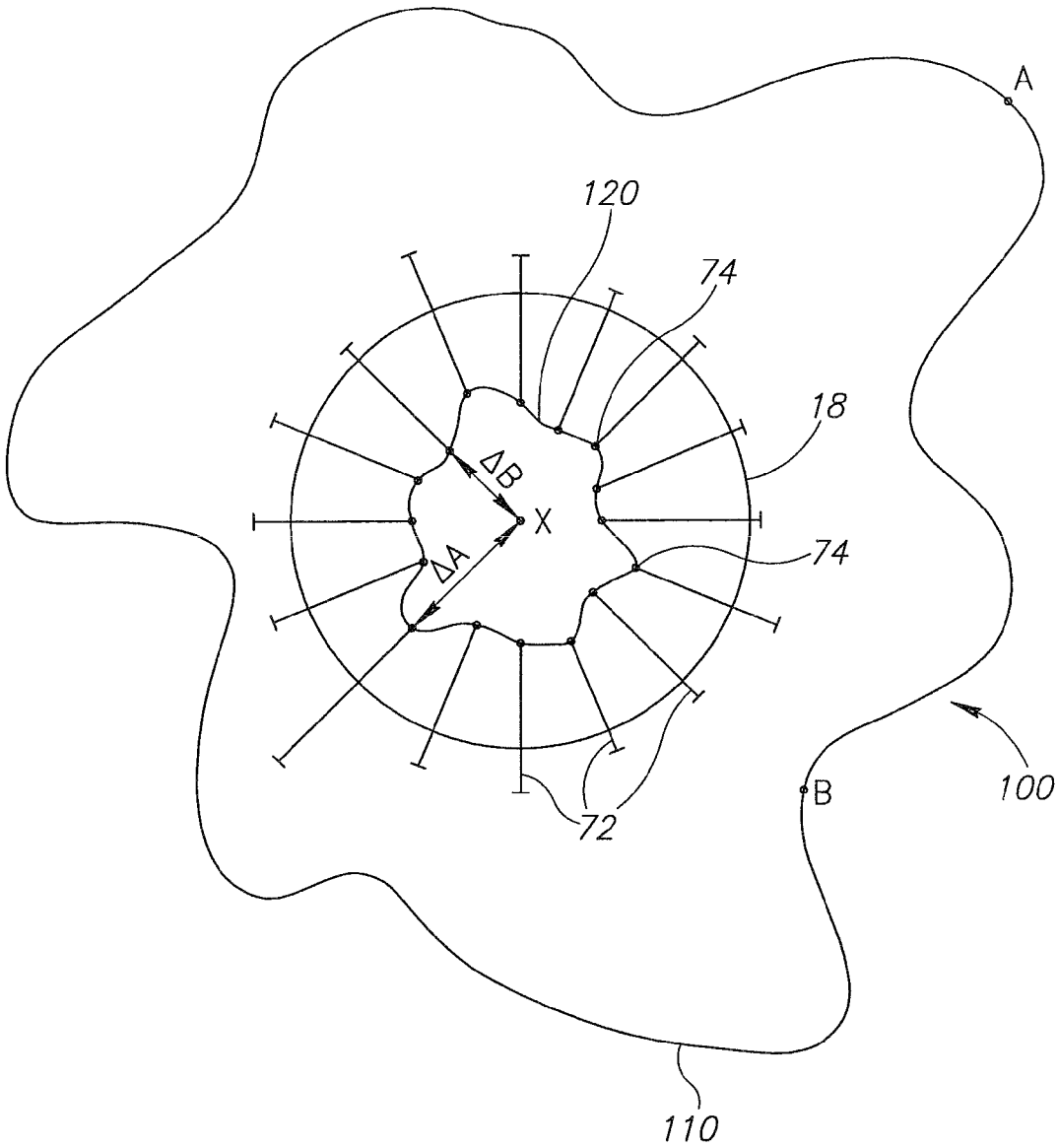
FIG. 6 is a schematic drawing of a lawn perimeter and arrangement of biasing elements used in the sprinkler of FIG. 1A.

Turning to FIG. 6, a lawn 100 is schematically shown to have an amorphic geometric contour 110. The sprinkler is positioned within the lawn and the sprinkler top 18 with biasing elements 70 is also schematically shown. The biasing elements 70 are so positioned with respect to the central axis X-X of the sprinkler 10 that the an imaginary line joining all the biasing ends 74 forms an amorphic sprinkler contour 120, which is proportionally inverse to the lawn contour 110 of the lawn 100.

For example, in order for water from the sprinkler to reach a distant point A on the lawn contour, the biasing end 74 of the corresponding biasing element 70, positioned opposite point A about the central axis X-X, needs to be spaced from the central axis X-X to an extent AA, corresponding to the distance of point A from the axis X-X. For a proximal point B, the biasing end 74 of the corresponding biasing element 70 needs to be spaced closer to the central axis X-X, to an extent $\Delta B$, such that $\Delta B<\Delta A$.

Thus, by presetting the biasing elements 70, the biasing end 74 thereof may be manipulated so as to allow the sprinkler to perform irrigation of virtually any possible lawn contour.

Figure 7A:
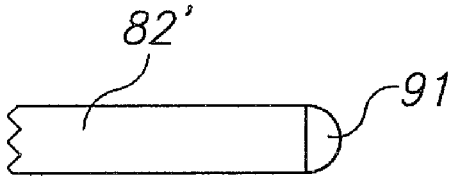
FIGS. 7A to 7D illustrate samples of distal ends of a flow regulator.
Figure 7B:
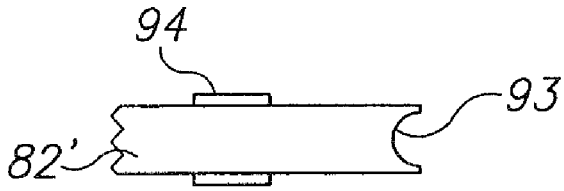
Figure 7C:
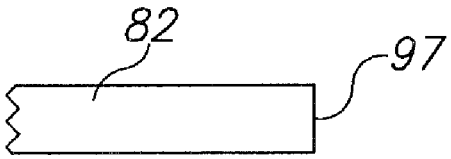
Figure 7D:
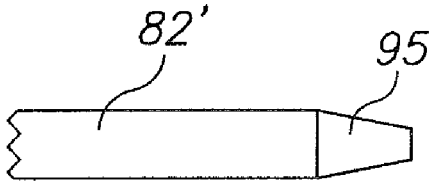

With further attention to FIGS. 7A to 7D there are illustrated samples of distal ends of plunger 82' to thereby obtain different flow patterns towards the second outlet 32. In FIG. 7A the plunger tip 91 is hemispheric; in FIG. 7B the plunger tip 93 has a half-circle section and in order to retain its orientation within the extension 34 (FIG. 2) a key 94 is provided for engagement by a corresponding groove (not shown) in the extension; in FIG. 7C the plunger tip 95 has the shape of truncated cone and in FIG. 7D the plunger has a flat tip 95. It is realized that other shapes may be imparted to the distal ends of the plunger, depending however on the desired result.

Figure 8:
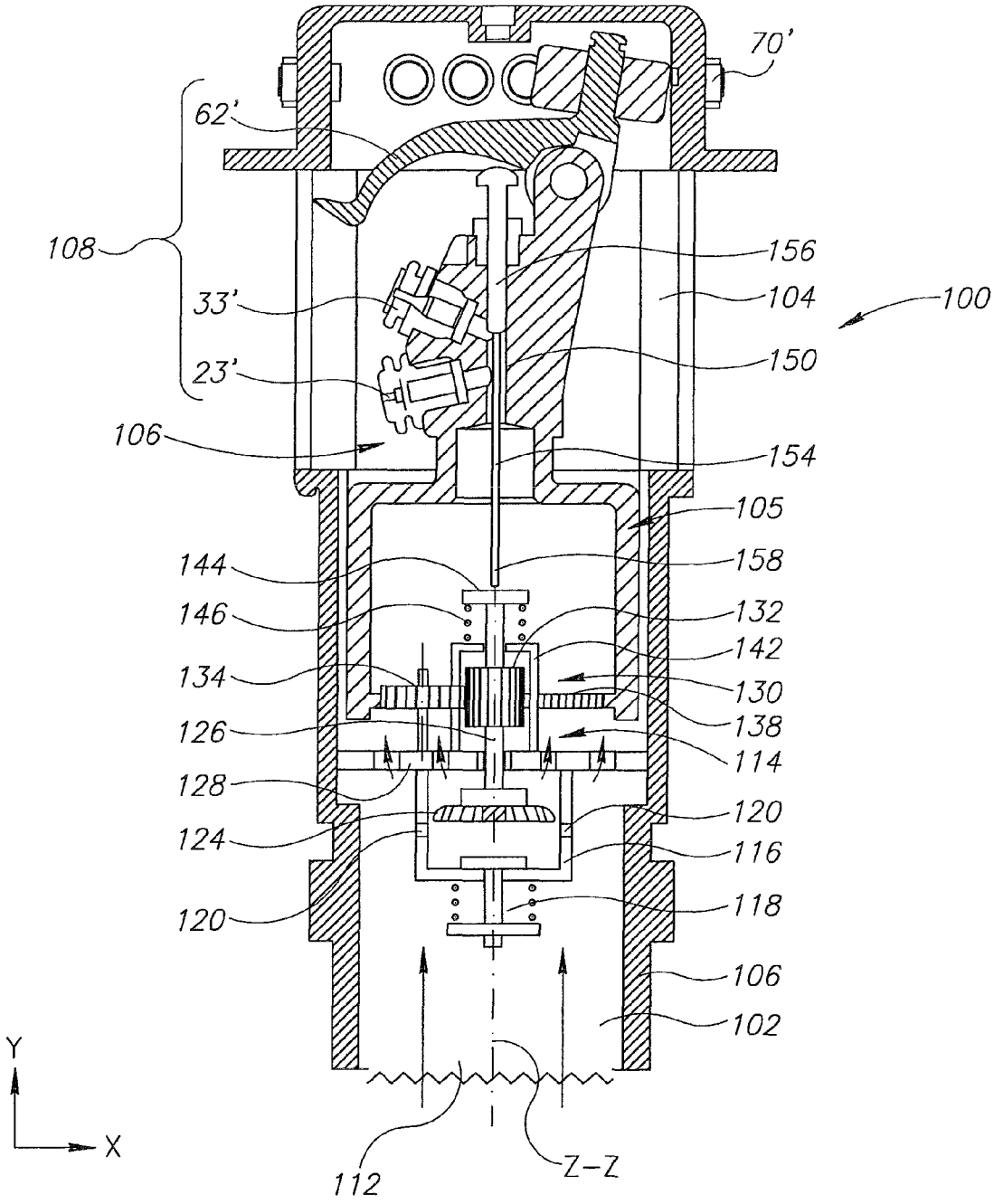
FIG. 8 is a longitudinal section of a sprinkler according to another embodiment of the present invention.

Further attention is now directed to FIG. 8 of the drawings illustrating a longitudinal section through a sprinkler in accordance with an embodiment of the invention, generally designated 100.

The sprinkler is formed with a housing 102 stationary fixable to a liquid supply line (not shown). A sprinkler head 104 is fixedly mounted on the housing 102 by a downwardly extending skirt 105 coaxially mounted over the stationary housing cylinder 102. Rotatably mounted on the housing 102 there is a distribution head 106. An irrigation head generally designated 108 (composed of the sprinkler head 104 and the distribution head 106) is fitted at the top of the housing 102 and is substantially similar to that disclosed in connection with the previous embodiment.

Housing 102 is formed with a flow chamber 112 being in direct flow communication with the supply line (not shown). Extending within the housing 102 there is a hydraulic motor generally designated at 114 comprising a turbine chamber 116 in the form of a closed chamber fitted at its bottom end with a one-way inlet valve 118 and with one or more tangentially extending inlets 120 adapted for generating a flow in a tangent direction giving rise to rotation of a turbine wheel 124 mounted on an axle 126 coaxial with a longitudinal axis Z-Z of the sprinkler.

The axle 126 projects through an upper wall 128 of the chamber 116 and is fitted with a gear transmission generally designated 130 comprising a first gear wheel 132 mounted on the axle 126 and a second gear wheel 134 which in turn is rotatably engaged with an internally geared portion 138 of the skirt portion 105 of the sprinkler head 104.

It is noticed that axle 126 extends into a housing 142 and projects through its top end terminating with a plate segment 144 where it is normally biased upwards owing to coiled spring 146 bearing at its upper end at the bottom end of plate segment 144 and at its bottom end on a top surface of the housing 142. This arrangement results in that the gear transmission 130 together with the turbine 124 are axially displaceable within the housing 102, however without disengaging any of the gear transmission assembly from one another during such axial displacement.

Such axial displacement within the housing 102 entails corresponding displacement of the turbine 124 opposite the tangential openings 120 resulting in increasing/decreasing of the rotational speed of the turbine 124 owing to its change of location with respect to the tangential openings 120, i.e. strengthening/weakening the impinging effect of water jets immersing through the apertures 120 about the turbine wheel 124.

Any change in rotational speed of the turbine 124 is reflected in corresponding change of rotation of the distribution head 106 which in turn is articulated thereto, as discussed hereinabove.

Contrary to the previous embodiment, the plunger 156 of the flow regulator is received within a throughgoing recess 150 with a rod 154 extending from the plunger 156, said rod bearing at its lower end 158 against the plate portion 144 integral with the axle 126. The plunger 156 and the rod 154 may be, according to an embodiment of the invention, a unitary item with the upper part thereof not interfering with flow rate through the second nozzle.

In operation, after the array of biasing elements 70 has been set in accordance with the contour of the area to be irrigated (this is performed in the same manner as disclosed in connection with the previous embodiment, resulting in the same flow regulation of the liquid immersing through the second nozzle 33' and in corresponding deflection of the deflector arm 62') the rod 154 will axially displace in correspondence with axial displacement of plunger 156 of the flow regulator resulting in axial displacement of the axle 126 and the turbine 124 articulated thereto.

As a result, when the deflection arm 62' is pivoted in a counter-clockwise direction owing to the position of an in-duty biasing element 70', it will depress the rod 154 resulting in corresponding faster rotation of the distribution head 106, at a lower flow rate, suited for shorter range irrigation. However, when the in-duty biasing element 70' is axially retracted the plunger 156 projects moiré, resulting in that the rod 154 does not apply pressure on axle 126 whereby the turbine 124 is at its maximal elevation suited for an increased jet flow rate, for output of slower speed suited for irrigation at longer range.

This will result in maintaining a substantially constant liquid precipitation over the irrigated area.

It is noted that the first nozzle 23', adapted for irrigation at the shorter range is in flow communication with the flow chamber 112 and the liquid supplied to the nozzle 23' remains at a substantially constant flow rate, regardless of any change in speed of the sprinkler. The second nozzle 33' however emits a nozzle eject at altering flow rates, responsive to axial displacement of plunger 156 (and may further be deflected by the deflector arm 62') depending on the extent of radial displacement of the biasing elements, in compliance with the contour of the irrigated area. However, the irrigation head with both nozzles rotate at a varying speed which is a resultant of the contour of the irrigated pattern, as disclosed hereinabove.

Figure 9:
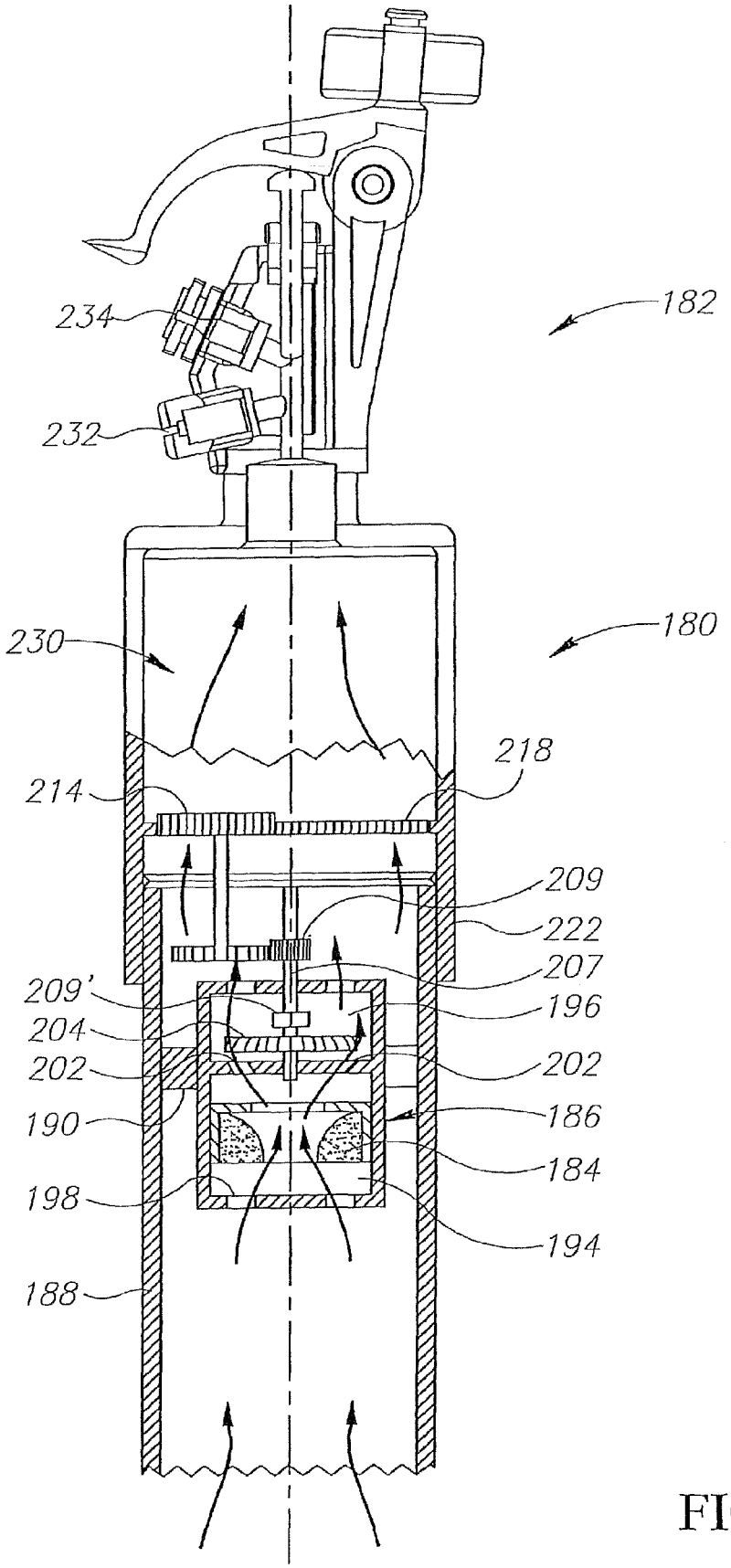
FIG. 9 is partially sectioned longitudinal view of a sprinkler according to a modification of the invention, with the sprinkler head removed.

The sprinkler 180 illustrated in the embodiment of FIG. 9 is similar to the previous embodiments as far as the irrigation head 182 (sprinkler head not shown) with the major difference residing in the provision of a flow regulator designated at 184 fitted within a hydraulic motor assembly generally designated 186. The motor assembly is secured within the static housing 188 by several supports 190, however enabling liquid flow also upwards towards the irrigation head and the respective nozzles, as discussed herein before in connection with the previous embodiments. The housing 182 is further formed with a first compartment 194 accommodating the flow regulator 184 and a accommodating the hydraulic motor.

The first compartment 194 is formed with one or more flow inlets 198 and several inclined outlets 202 extending into the second compartment 196 such that liquid jets emitted therefrom impinge with blades of a turbine wheel 204 received within the second compartment 196 and impart the turbine rotary motion. The turbine is mounted on an axle 207 which is fitted at an upper end thereof with a pinion gear 209 extending outside said second compartment. Pinion gear 209 is engaged with a gear train 212 for speed reduction, which gear train ends with a rotation gear 214 engaged in turn with a gear rack 218 formed at the skirt portion 222 of the sprinkler head.

The arrangement is such that liquid enters the housing 188 and into the flow regulator compartment 194 from which it flows into the motor compartment at a substantially constant flow rate to rotate the hydraulic motor, resulting in rotation of the irrigation head. Liquid then flows into the irrigation head chamber 230 and further towards the first nozzle 232 and the second nozzle 234.

Whilst several embodiments have been shown and described, it is to be understood that it is not intended thereby to limit the disclosure of the invention, but rather it is intended to cover all modifications and arrangements falling within the spirit and the scope of the invention, mutatis mutandis.

The invention claimed is:

1. A sprinkler for discharging liquid onto an area with a predetermined geometrically shaped perimeter, the sprinkler comprising:

a housing fitted with a flow chamber, the flow chamber accommodating a hydraulic motor for rotating a sprinkler head mounted on the housing, and including an outlet end, the housing including:

a first nozzle, and a second nozzle being in flow communication with the outlet end of the flow chamber;

a dynamic liquid deflector associated with the second nozzle, and biased by an array of biasing elements, each of the biasing elements adapted to dynamically bias the dynamic liquid deflector to a predetermined angle, thereby determine a deflection angle thereof whilst maintaining a substantially constant liquid precipitation over the area; and a cam follower associated with the dynamic liquid deflector;

wherein the sprinkler head is spaced from the housing, the biasing elements being independently radially displaceable within the sprinkler head so as to form an imaginary path extending between the biasing elements, and the cam follower travels over the biasing elements to thereby angularly dispose the dynamic liquid deflector.

2. A sprinkler according to claim 1, wherein the housing is fitted with a first feed line and a second feed line, the first feed line and the second feed line extending from the flow chamber and the first feed line having a first outlet end and the second feed line having a second outlet end, the first feed line extending through the hydraulic motor to thereby rotate the sprinkler head at a substantially constant speed, the first feed line fitted at the first outlet end of the first feed line with the first nozzle fitted for discharging a liquid at a substantially constant flow rate; the second feed line being fitted at the second outlet end of the second feed line with the second nozzle.

3. A sprinkler according to claim 1, wherein the second nozzle is in flow communication with a second feed line fitted with a flow regulator for regulating liquid flow discharged through the second nozzle, where deflection of the dynamic liquid deflector entails simultaneous governing of the flow regulator, to thereby emit liquid through the second nozzle at a flow rate corresponding with a range set by a respective biasing element.

4. A sprinkler according to claim 3, wherein sprinkler head is rotatable and the flow regulator comprises a plunger at least partially impinging with the second feed line, thereby restricting a cross-section of the second feed line and obstructing fluid flow.

5. A sprinkler according to claim 4, wherein the plunger is interchangeable by plungers having different cross sections, allowing intricate regulation of the discharged liquid.

6. A sprinkler according to claim 1, wherein the first nozzle is adapted for discharging liquid at a constant flow rate at substantially short range and over a circular pattern.

7. A sprinkler according to claim 1, wherein the second nozzle is fitted for discharging liquid at a variable flow rate and at longer ranges.

8. A sprinkler according to claim 1, the sprinkler further comprising a sprinkler top, wherein the biasing elements are radially directed towards a longitudinal axis of the sprinkler, each biasing element being radially displaced within the sprinkler top so as to adjust a distance of a proximal end of each biasing member from the longitudinal axis.

9. A sprinkler according to claim 1, wherein the sprinkler head is rotatable and the dynamic liquid deflector is a pivotally coupled to the rotatable sprinkler head.

10. A sprinkler according to claim 9, wherein the sprinkler top is spaced from the housing by one or more support studs having a hydrodynamic cross-section so as to cause minimal interference with liquid jets emitted from the first nozzle and the second nozzle.

11. A sprinkler according to claim 1, wherein the sprinkler head is rotatable and the dynamic liquid deflector forms a deflecting arm pivotally articulated to the rotatable sprinkler head such that a deflecting end of the dynamic liquid deflector extends in front of the second nozzle for selectively deflecting liquid emitted therefrom and the cam follower member is fitted on the dynamic liquid deflector for engagement with an array of radial biasing elements.

12. A sprinkler according to claim 11, wherein a middle portion of the deflecting arm bears over a distal end of the flow regulator plunger projecting from the sprinkler head, whereby deflection of the dynamic fluid deflector governs an amount the plunger of the flow regulator impinges with a second feed line, to thereby regulate liquid flow emitted from the second nozzle in correlation with a desired angle of discharge.

13. A sprinkler according to claim 12, wherein the plunger includes a concave surface at a distal end thereof, the concave surface corresponding with a bottom surface of the flow deflecting arm such that pivotal displacement of the deflecting arm entails substantially pure rolling motion over the plunger.

14. A sprinkler according to claim 11, wherein liquid from the flow chamber flows into a first inlet end of a first feed line and a second inlet end of a second feed line, whereby liquid flowing through the first feed line passes through the hydraulic motor, thereby operating the hydraulic motor and causing constant rotary motion of a discharge port of the sprinkler and upon exiting the hydraulic motor, the liquid flows through the first nozzle and provides a constant liquid flow rate at a constant angle to the area.

15. A sprinkler according to claim 11, wherein during rotation of the sprinkler head, the cam follower of the dynamic liquid deflector alternately comes in contact with a different biasing element, thereby an extent of obstruction of a flow through a second feed line towards the second nozzle varies in accordance with a radial projection of each biasing element and simultaneously a distal end of the flow regulator is biased downwards at a corresponding extent consequently deflecting liquid emitted from the second nozzle.

16. A sprinkler according to claim 11, wherein the hydraulic motor comprises an impeller mechanism articulated with a rotary distribution member accommodating the first nozzle and the second nozzle and being in flow communication with the flow chamber via a first feed line.

17. A sprinkler according to claim 1, wherein deflection of the dynamic liquid deflector determines an extent the deflecting end thereof obstructs the second nozzle, and consequently a range of liquid discharge, as well as an extent the flow regulator interferes with a feed line of the second nozzle, and consequentially a liquid flow rate through the second nozzle.

18. A sprinkler according to claim 1, wherein liquid flowing through the second nozzles obstructable by a deflecting end of the dynamic liquid deflector and flow of the liquid is governed by the flow regulator.

19. A sprinkler according to claim 1, wherein the hydraulic motor is dynamic and has a speed regulator for governing rotary speed of the sprinkler head depending on a flow rate emitted through the second nozzle, wherein the dynamic hydraulic motor is linked to the dynamic liquid deflector whereby deflection of the liquid deflector results in change of rotary speed of the dynamic hydraulic motor.

20. A sprinkler according to claim 19, wherein variable speed of the dynamic hydraulic motor is obtained by a coupler associated at one end with the dynamic liquid deflector and at an opposite end thereof with an axially displaceable turbine of the dynamic hydraulic motor, the turbine being mounted within a chamber formed with one or more tangentially extending liquid jet apertures, whereby axial displacement of the turbine results in an axial displacement of the turbine with respect to the one or more apertures, which in turn entails reducing/increasing of a rotation speed of the turbine and an associated irrigation head.

21. A sprinkler according to claim 1, wherein the flow chamber of the housing is fitted with a flow control valve for generating a substantially constant liquid flow rate to a turbine chamber of the hydraulic motor and towards the first nozzle and the second nozzle.

22. A sprinkler according to claim 21, wherein liquid flow simultaneously diverts towards the flow control valve and the turbine chamber of the hydraulic motor and towards the first nozzle and the second nozzle.

23. A sprinkler for discharging liquid onto an area with a predetermined geometrically shaped perimeter, the sprinkler comprising:

a housing fitted with a flow chamber, the flow chamber accommodating a hydraulic motor for rotating a sprinkler head mounted on the housing, and including a first outlet end and an outlet end, the housing including:

a first nozzle, and a second nozzle being in flow communication with the outlet end of the flow chamber;

a dynamic liquid deflector associated with the second nozzle, and biased by an array of biasing elements, each of the biasing elements adapted to dynamically bias the dynamic liquid deflector to a predetermined angle, thereby determine a deflection angle thereof whilst maintaining a substantially constant liquid precipitation over the area; and a cam follower associated with the dynamic liquid deflector;

wherein the dynamic liquid deflector forms an arm pivotally articulated to the sprinkler head such that a deflecting end of the dynamic liquid deflector extends in front of the second nozzle for selectively deflecting liquid emitted therefrom and the cam follower member is fitted on the dynamic liquid deflector for engagement with an array of radial biasing elements.

24. A sprinkler for discharging liquid onto an area with a predetermined geometrically shaped perimeter, the sprinkler comprising:

a housing fitted with a flow chamber, the flow chamber accommodating a hydraulic motor for rotating a sprinkler head mounted on the housing, and including a first outlet end and an outlet end, the housing including:

a first nozzle, and a second nozzle being in flow communication with the outlet end of the flow chamber; and a dynamic liquid deflector associated with the second nozzle, and biased by an array of biasing elements, each of the biasing elements adapted to dynamically bias the dynamic liquid deflector to a predetermined angle, thereby determine a deflection angle thereof whilst maintaining a substantially constant liquid precipitation over the area, wherein the dynamic liquid deflector forms a deflecting arm pivotally articulated to the sprinkler head such that a deflecting end of the dynamic liquid deflector extends in front of the second nozzle for selectively deflecting liquid emitted therefrom and a middle portion of the deflecting arm bears over a distal end of the flow regulator plunger projecting from the sprinkler head, whereby deflection of the liquid deflector governs an amount the plunger impinges with a feed line, to thereby regulate liquid flow emitted from the second nozzle in correlation with a desired angle of discharge.

* * * * *